US006368173B1

(12) United States Patent
Runyan

(10) Patent No.: US 6,368,173 B1
(45) Date of Patent: Apr. 9, 2002

(54) FOOT RETENTION DEVICE

(76) Inventor: Max R. Runyan, 4922 Charlene Cir. #6, Huntington Beach, CA (US) 92649

( * ) Notice: Subject to any disclaimer, the term of this patent is extended or adjusted under 35 U.S.C. 154(b) by 0 days.

(21) Appl. No.: 09/643,503

(22) Filed: Aug. 22, 2000

(51) Int. Cl.[7] ..... B63B 35/85
(52) U.S. Cl. ..... 441/70; 280/611
(58) Field of Search ..... 441/70, 74; 280/611

(56) References Cited

U.S. PATENT DOCUMENTS

| | | | | |
|---|---|---|---|---|
| 4,028,761 | A | 6/1977 | Taylor | 441/65 |
| 4,604,070 | A | 8/1986 | McKee et al. | 441/75 |
| 4,693,199 | A | 9/1987 | Omachen et al. | |
| 4,775,345 | A | 10/1988 | Gifford | |
| 4,795,386 | A | 1/1989 | LaPoint | 441/68 |
| 4,846,744 | A | 7/1989 | Love | 441/75 |
| 4,850,916 | A | 7/1989 | Phillips | 441/74 |
| 4,871,337 | A | 10/1989 | Harris | 441/74 |
| 4,891,027 | A | 1/1990 | Plunkett | 441/70 |
| 4,960,063 | A | 10/1990 | Bontemps | |
| 4,964,649 | A | 10/1990 | Chamberlin | 280/618 |
| 4,969,655 | A | 11/1990 | Katz | 441/74 |
| 4,990,113 | A | 2/1991 | Morrison | |
| 5,018,468 | A | 5/1991 | Peterson | |
| 5,045,006 | A | 9/1991 | Sperzel et al. | |
| 5,090,722 | A | 2/1992 | Ritchie et al. | 441/70 |
| 5,125,859 | A | 6/1992 | Spurgeon | |
| 5,147,234 | A | 9/1992 | Brug | |
| 5,167,553 | A | 12/1992 | Wilson | |
| 5,199,735 | A | 4/1993 | Tonel | 280/615 |
| 5,378,181 | A | 1/1995 | Sewell | |
| 5,433,636 | A | 7/1995 | Gillis | 441/74 |
| 5,558,552 | A | 9/1996 | Namur | |
| 5,591,060 | A | 1/1997 | Forsyth | |
| 5,609,347 | A | 3/1997 | Dressel | 280/14.2 |
| 5,893,785 | A | 4/1999 | Baldwin, III | |
| 5,918,387 | A | 7/1999 | Emerson | |
| 6,056,300 | A | 5/2000 | Carpenter et al. | |

*Primary Examiner*—Jesus D. Sotelo
(74) *Attorney, Agent, or Firm*—Myers Dawes & Andras; Vic Y. Lin; Joseph C. Andras

(57) ABSTRACT

A foot retention device includes a rigid vertical strut and a springy band disposed adjacent to an exterior side of the strut and configured to flex over the strut to form a non-drooping asymmetric arc that conforms to the profile of a human foot. A releasable securing mechanism allows the band to be easily secured and released. The foot retention device provides a fixed right angle between a base plate and the vertical strut allowing the user's foot to be inserted straight in. The foot retention device includes a non-sloping design for athletic applications, and a sloping design for footwear. Methods of assembling and manufacturing the foot retention device are also provided.

18 Claims, 7 Drawing Sheets

FOOT RETENTION DEVICE

BACKGROUND OF THE INVENTION

1. Field of the Invention

The invention relates generally to the field of devices for retaining feet.

2. Description of Prior Art

Retention devices for feet are typically found on various sporting boards which are meant to be ridden. For instance, a conventional sailboard for windsurfing normally includes footstrap devices consisting of straps coupled to the top surface of the board to form a loop through which a user's foot is inserted Such straps are made of a soft, pliable material. While current footstraps may serve the general purpose of retaining the user's feet, several problems exist with conventional designs.

Current footstraps are deficient in providing comfort, convenience and safety. Since conventional footstraps are made of soft, pliable materials, the openings provided by such designs do not anatomically conform to the actual cross-section of a user's foot. As a result, current footstraps fit poorly across the human foot causing discomfort to the user. Inconvenience occurs each time the user's feet must be reinserted. Normally when a user inserts a foot into a footstrap, the big toe will first enter the opening. Some prior art footstraps provide a substantially symmetrical arch, thus forcing the user to insert each foot by aligning the big toe along the center of the opening where the height of the arch is greatest.

Current footstraps are also deficient in providing safety. With current footstraps, the user must pay special attention to appropriately reinsert his or her feet, thus diverting the user's attention from other surrounding perils, such as wind, waves or riders. The soft material of existing designs can cause the footstrap to twist easily, thus distracting the user who must use extra time and visual attention to reinsert his or her feet. In fast action activities involving boards such as windsurfing, kite sailing, and the like, a brief diversion of the rider's attention can cause major injuries. The twisting characteristics and anatomically incorrect shape of the footstraps can also prevent a user from being able to exit the strap. Failure to exit quickly can cause serious injury to the user especially in certain situations such as a pending crash.

For shoes, including sandals, typical straps which cover the top of the feet are also made of soft, pliable materials. Such straps may also cause discomfort and inconvenience for a user as they fail to provide an opening shaped according to the anatomy of the user's foot. For sandals, especially, drooping straps or covers make it a hassle to put on the sandal. In the case where a person has experienced injury to the foot thereby leading to swelling or sensitivity, putting on and removing a shoe can be a great burden given that current shoes do not sufficient provide an anatomically correct opening. Considering the amount of time spent wearing shoes and the frequency of putting on and taking off shoes by an average person on a daily basis, the amount of strain and inconvenience can be significant.

BRIEF SUMMARY OF THE INVENTION

The present invention provides structures and methods which overcome the deficiencies in the prior art.

In one aspect, a foot retention device is provided for releasably securing a user's foot adjacent to a base. The base has a big toe insertion region and small toe insertion region. The device comprises a substantially rigid vertical strut that extends perpendicularly from the base adjacent the big toe insertion region, a resilient band disposed adjacent to an exterior side of the strut and extending from an upper end of the vertical strut, and a fastener for releasably coupling a far end of the resilient band to the small toe insertion region. The vertical strut and the resilient band combine to form an asymmetric arc profile conforming to a profile of the user's foot.

In the preferred embodiment, the resilient band preferably comprises metal and has a uniform thickness. The band may comprise a spring-back cantilever. The vertical strut may include a horizontal member that is coupled to the base. The resilient band includes a near end that is coupled to the horizontal member. The fastener comprises a strap coupled to the band. A securing mechanism may be disposed at the small toe region of the base for releasably engaging with the fastener. In the casual embodiment, the vertical strut and the resilient band are sloped to provide an inlet opening that is larger than an outlet opening.

In another aspect, a stand-up riding apparatus, such as a windsurfing board, for example, is provided. The riding apparatus comprises a board having a substantially flat upper surface for supporting a user's feet, a rigid vertical wall coupled to the board and extending from the upper surface of the board to form a fixed angle for receiving a big toe of the user's foot, and a springy band having a near end disposed adjacent to a first side of the wall. The band is bent over and shouldered by the wall to extend to a far end disposed beneath a top of the wall when the far end is coupled to the board. The rigid vertical wall and the springy band collectively form an asymmetric profile conforming to a profile of the user's foot. The apparatus further comprises a fastener releasably coupling the far end of the band to the board. In the preferred embodiment, the band preferably has a uniform thickness and comprises metal.

In a further aspect, a footwear is provided incorporating the foot retention device according to the invention. The footwear comprises a sole having a medial region, a lateral region and an upper surface, a rigid vertical strut disposed adjacent to the medial region of the sole and extending perpendicularly to the upper surface, the rigid vertical strut having a medial side and a lateral side, and a resilient band. The resilient band has a first portion disposed adjacent to the medial side of the strut, a second portion extending over the strut, and a far end disposed adjacent to the lateral region of the sole. The footwear further comprises a fastener releasably coupling the far end of the band to the lateral region of the sole. A horizontal base plate is coupled to a bottom portion of the vertical strut. The sole comprises a transverse slot in which the base plate is disposed. A mechanism is coupled to a lateral portion of the base plate to couple the far end of the band. The vertical strut and the band are sloped toward a front end of the sole to provide an outlet opening and an inlet opening that is larger than the outlet opening.

A method of assembling a stand-up riding apparatus is also provided. The method comprises: providing a board with an upper surface for supporting a rider's feet; coupling a rigid vertical strut to the board; disposing a flexible metallic band adjacent to an inboard side of the rigid vertical strut; bending the flexible metallic band over a top of the rigid vertical strut; and releasably coupling a far end of the flexible metallic band to the board. Releasably coupling a far end of the flexible metallic band to the board comprises forming an asymmetric arc with the flexible metallic band by coupling to the flexible metallic band a strap with a releasable mechanism. Coupling a rigid vertical strut to the board comprises forming a right angle between the strut and the upper surface of the board for insertion of a big toe of the user.

A method of manufacturing a shoe is also provided. The method comprises: providing a sole with a medial portion and a lateral portion; coupling a rigid vertical strut to the medial portion of the sole; disposing a flexible metallic band along a medial side of the rigid vertical strut; coupling a fastener to the band to releasably couple a far end of the band to the lateral portion of the sole. Coupling a rigid vertical strut to the medial portion of the sole comprises forming a right angle between the strut and the sole. The method may further comprise coupling a horizontal base plate to a bottom portion of the rigid vertical strut. If a casual footwear is desired, the method comprises sloping the rigid vertical strut and the flexible metallic band toward a front end of the sole. The method further comprises forming a transverse slot in the sole; disposing the horizontal base plate in the transverse slot.

In summary, a foot retention device includes a rigid vertical strut and a springy band disposed adjacent to an exterior side of the strut and configured to flex over the strut to form a non-drooping asymmetric arc that conforms to the profile of a human foot. A releasable securing mechanism allows the band to be easily secured and released. The foot retention device provides a fixed right angle between a base plate and the vertical strut allowing the user's foot to be inserted straight in. The foot retention device includes a non-sloping design for athletic applications, and a sloping design for footwear. Methods of assembling and manufacturing the foot retention device are also provided.

The invention, now having been briefly summarized, may be better visualized by turning to the following drawings wherein like elements are referenced by like numerals.

The invention and its various embodiments can now be better understood by turning to the following detailed description wherein illustrated embodiments are described. It is to be expressly understood that the illustrated embodiments are set forth as examples and not by way of limitations to the invention as defined in the following claims.

DETAILED DESCRIPTION OF THE PREFERRED EMBODIMENTS

Figure 1:
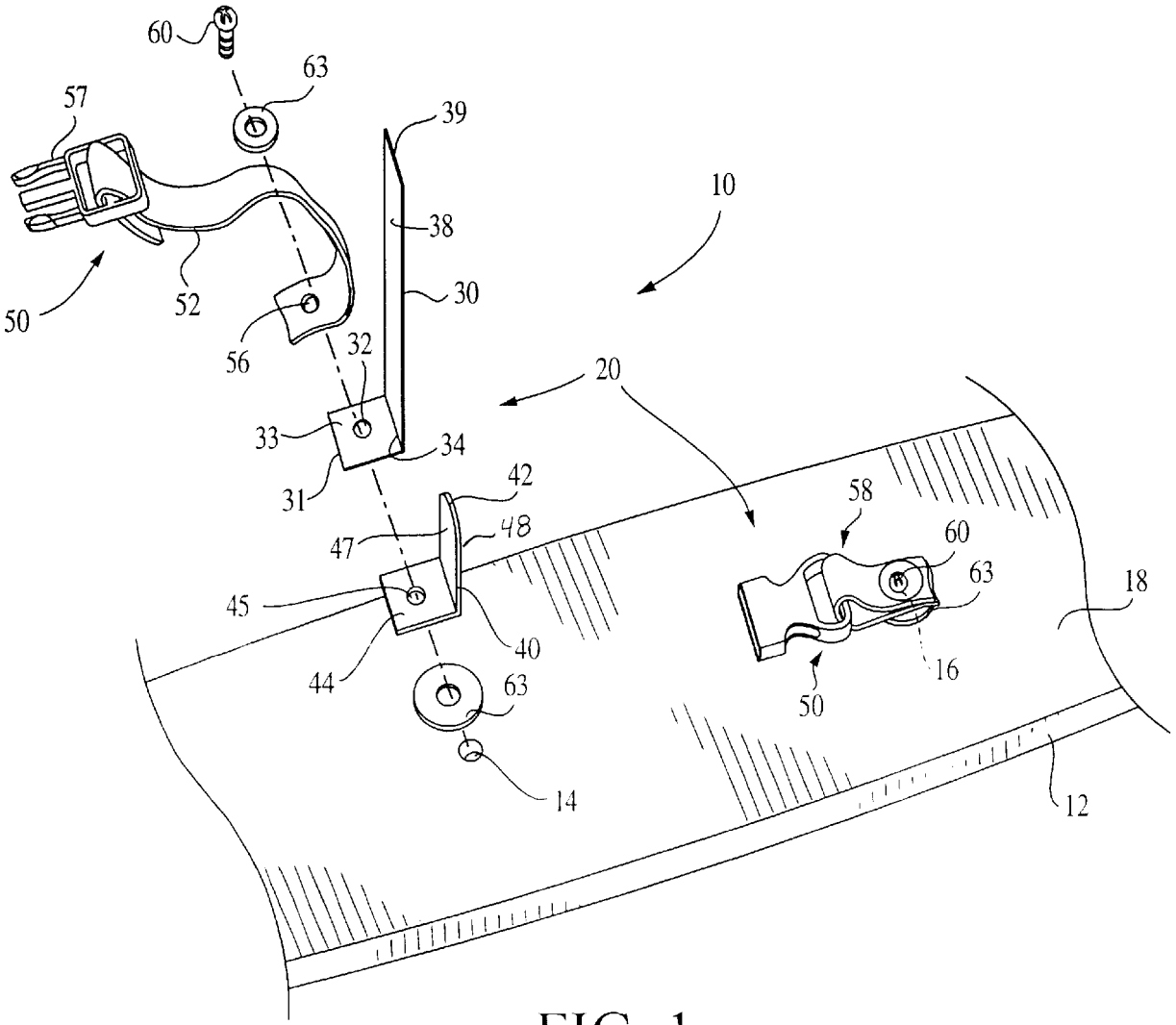
FIG. 1 is an exploded view of a board assembly incorporating a foot retention device according to the invention.

FIG. 1 is an exploded view of a riding apparatus, or assembly, 10 incorporating a foot retention device 20 according to the present invention. The riding apparatus 10 may comprise any board 12 having an upper surface upon which a user places his or her feet. For instance, the board 12 includes sailboards for windsurfing, water ski boards, snowboards, skis, and the like. Though the preferred embodiment of the foot retention device 20 contemplates barefoot usage, the foot retention device 20 may also receive a shoe, such as a boot, worn by the user in riding a board.

Figure 2:
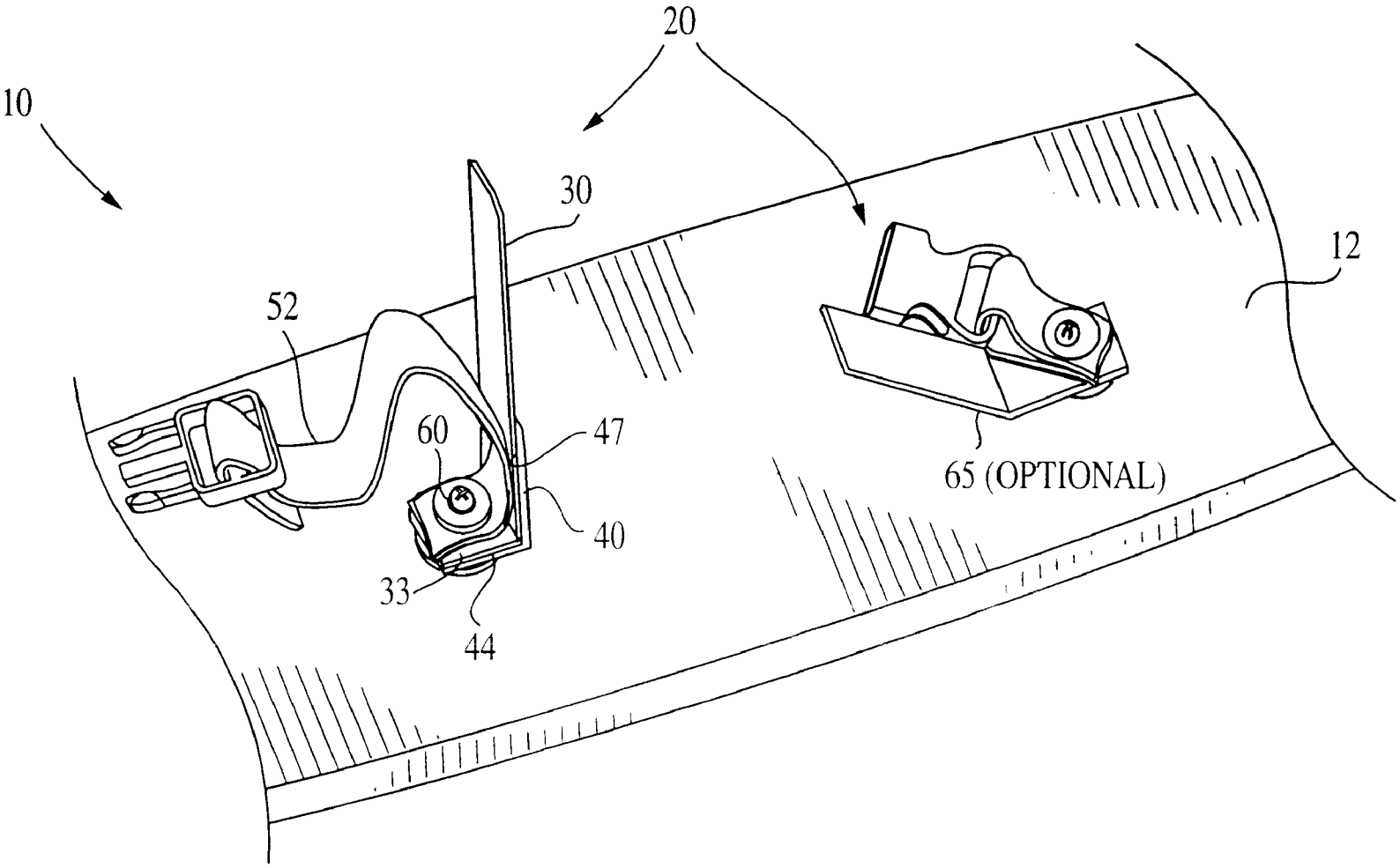
FIG. 2 is a perspective view of the board assembly with the foot retention device in an open configuration.

In FIGS. 1 and 2, the board 12 includes holes 14, 16 formed in an upper surface 18 to enable the foot retention device 20 to coupled thereto. With respect to the foot retention device 20, the first hole 14 defines an inboard point while the second hole 16 defines an outboard point. The foot retention device 20 comprises a resilient band 30 composed of a flexible material having elastic, spring-back properties. In the preferred embodiment, the band 30 comprises a thin, flexible metallic band. The band 30, however, may also comprise non-metallic materials which are resilient enough to bend, but rigid enough to maintain a certain profile when bent. Thus, a variety of materials, such as metal, which would generally be considered rigid and not flexible, may become flexible if a band comprising such material is sufficiently thinned to a thickness that would allow the band to bend. As examples, other materials may include carbon fiber, composites, reinforced plastics and more. In the preferred embodiment, the band has a relatively small thickness, which, by way of example, may be 0.010 inch. The band 30 includes a fixed, near end 31 and a free, far end 39. By forming a bend 34 in the band 30, which may be permanent or temporary, a horizontal portion 33 of the band 30 is provided for coupling to the board 12. The band 30 further comprises a near portion 33 and a far portion 38.

The foot retention device 20 further comprises a rigid vertical strut, or wall, 40. A top 42 of the vertical strut is preferably rounded to allow the band 30, when secured in a closed position, to move freely over the strut 40. The strut 40 may include a horizontal strut portion 44 for coupling to the board 12. The band 30 is disposed adjacent to an outboard, or exterior, side 47 of the strut. Alternatively stated, the band 30 is disposed adjacent to a first side 47 of the strut 40 that is opposite to the second side of the strut which faces the user's foot. A releasable securing mechanism 50 is coupled to the band 30 to secure the band 30 in a closed, operative configuration, as will be later described. In the preferred embodiment, the securing mechanism 50 comprises a releasable strap 52 coupled to the band 30 and a receiving structure 58 the strap 52. The strap 52 may include Velcro portions such that the strap 52 can be secured unto and released from itself when looped through the receiving structure 58. Alternatively, the strap 52 may include a releasable fastener 57, such as a buckle, which mates with the corresponding receiving structure 58. It is to be expressly understood that a variety of securing mechanisms 50 may be used to releasably couple the free end 39 of the band 30 to the board 12. For instance, though the strap 52 in FIG. 1 is shown as a thin strip disposed on top of the band 30, an enveloping strap may be provided which completely covers the band. The enveloping strap may include cushioning on an underside surface to provide comfort to the user's foot.

A first, or near, fastener 60 couples the band 30, strut 40 and strap 52 to the board 12. In the preferred embodiment, the fastener 60 comprises a bolt that is inserted through apertures 32, 45, 56 of the band 30, horizontal strut portion 44, and strap 52, respectively, as shown in FIG. 1, and received by the first hole 14 formed in the top surface 18 of the board 12. Thus, the band 30 is preferably coupled to the horizontal strut portion 44 thus forming a joint that allows the band, when secured in the closed position, to twist easily in response to movements in the user's foot received therein. Though the band 30 may be attached to vertical strut 40, such a joint causes greater tension and force to be applied to thereto as the band 30 is restricted in movement. The horizontal band portion 33 may also be welded to the horizontal strut portion 44. In the preferred embodiment, the receiving structure 58 of the securing mechanism 50 is spaced apart from the vertical strut 40 at a distance large enough to accommodate the width of any human foot. Washers 63 may be employed to receive the fasteners 60 and provide a dynamic spring back action allowing the foot retention device 20 to pivot freely. In FIG. 2, an optional rail 65 may be employed to secure the band 30 down in the operative configuration and to provide symmetrical spring back action.

Figure 3:
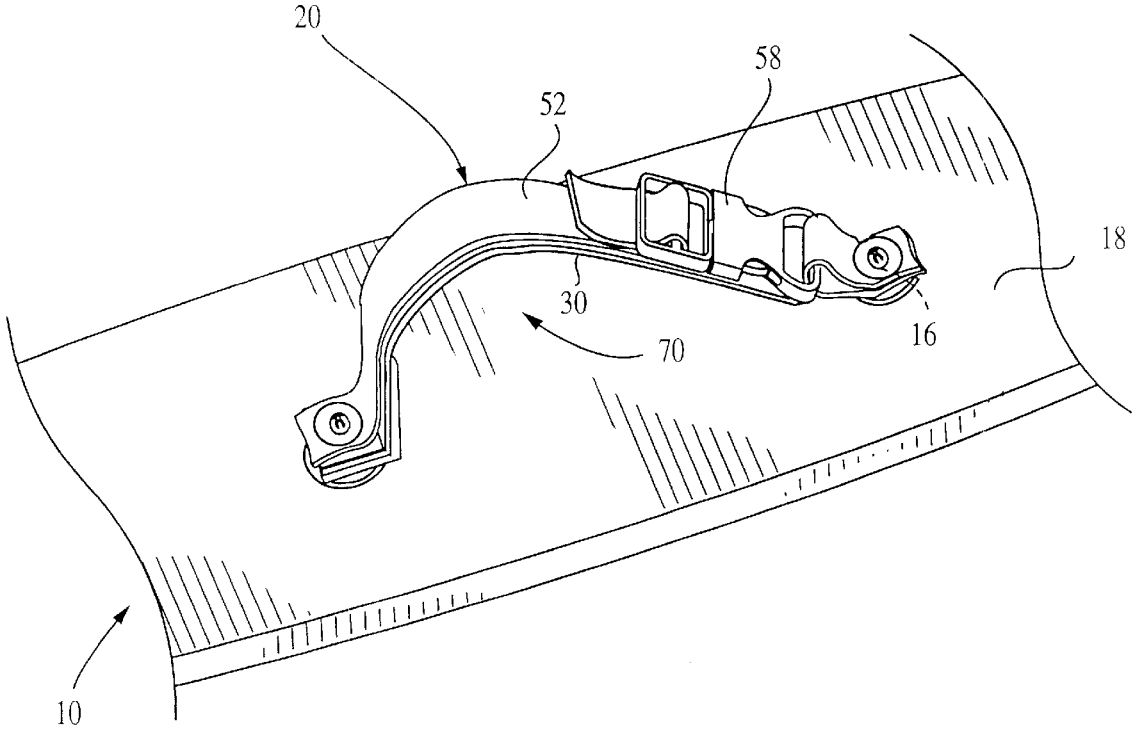
FIG. 3 is a perspective view of the board assembly of FIG. 2 with the foot retention device in a closed, operative configuration.
Figure 4:
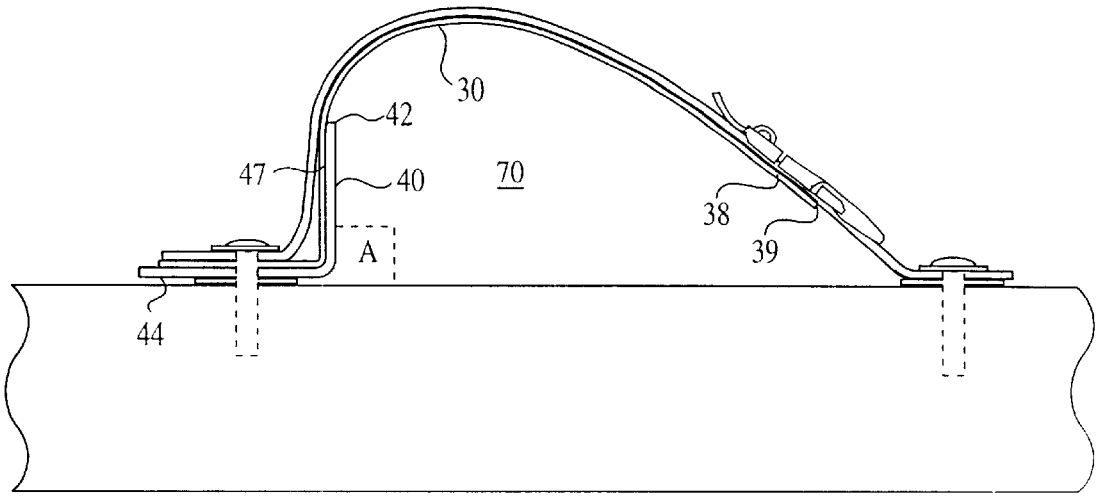
FIG. 4 is a rear view of the foot retention device.

FIGS. 3 and 4 show the riding apparatus 10 with the foot retention device 20 in a closed, operative configuration. The resilient band 30 is disposed adjacent to an exterior side 47 of the strut 40 and flexed over the vertical strut 40 and held in place by the strap 52 which is secured to the outboard point 16 by the receiving structure 58. It will be appreciated that since band 30 comprises metal in the preferred embodiment, the band 30 will have elastic, spring back properties which inclines the band 30 to return to its open, vertical configuration. This creates a fixed opening 70 defined by the asymmetric arc of the band 30 which, unlike prior art straps, does not droop. In addition, the opening 70 through which the user's foot is inserted comprises a right angle that is permanently maintained by the vertical strut 40 and the horizontal upper surface 18 of the board 12. This permanent right angle "A", as shown in FIG. 4, creates easy entry and exit of the big toe of the user and, thus, allows the user to insert his or her foot straight in through the opening.

Unlike the prior art footstraps, a user need not align his big toe with a center of the footstrap in order to insert his or her foot. Furthermore, the user need not spend any effort untangling since the rigid structure of the foot retention device prevents it from being tangled. Quick exits and entry are critical for a rapid action sport such as windsurfing. It will be appreciated that by creating a right angled opening with a non-drooping asymmetric arc which allows straight foot insertion, the user need not look down or direct any considerable attention to reinsertion. Furthermore, the asymmetric arc formed by the flexible metallic band 30 being shouldered by the vertical strut 40 conforms closely to the profile of a human foot, thus providing enhanced comfort and performance. Specifically, the arc has a greater radius of curvature adjacent to the vertical strut 40 as it extends to a maximum height, or peak, "H" and then tapers downwardly. Alternatively stated, when the band 30 is held in a closed, operative position, a near portion 33 of the band 30 has a greater curvature than the far portion 38 due to the vertical strut 40 shouldering the band 30. Thus, the peak "H" is located closer to the vertical strut 40 than the outboard point 16 just as the peak of a human foot profile is defined closer to the foot's medial side than the lateral side. In FIG. 4, the far end 39 of the flexed band 30 is disposed at a point beneath the top 42 of the vertical strut 40 to form the asymmetric arc. With the band 30 being fixed at the horizontal joint (i.e. the coupling of the horizontal band 33 and the horizontal strut portion 44), the band 30 is free to slightly twist in response to the user's foot movements.

The springy qualities of the band 30 cause it to return to its original configuration as the user's foot moves back to its original position. This foot conforming shape provides a much more comfortable feel and greater ease of entry and exit than prior art footstraps. At the same time, the springy, elastic properties of the band material also allows the band 30 to move in conformity with the upper surface of a rider's foot as the rider engages in maneuvers. This continuous spring back pressure and full foot contact across the top of the foot provides constant feedback and feel to the user for precise steering control throughout the entire angular range of foot motion and activity. The strap 52 may be tightened or loosened to vary the size of the opening 70.

Figure 5:
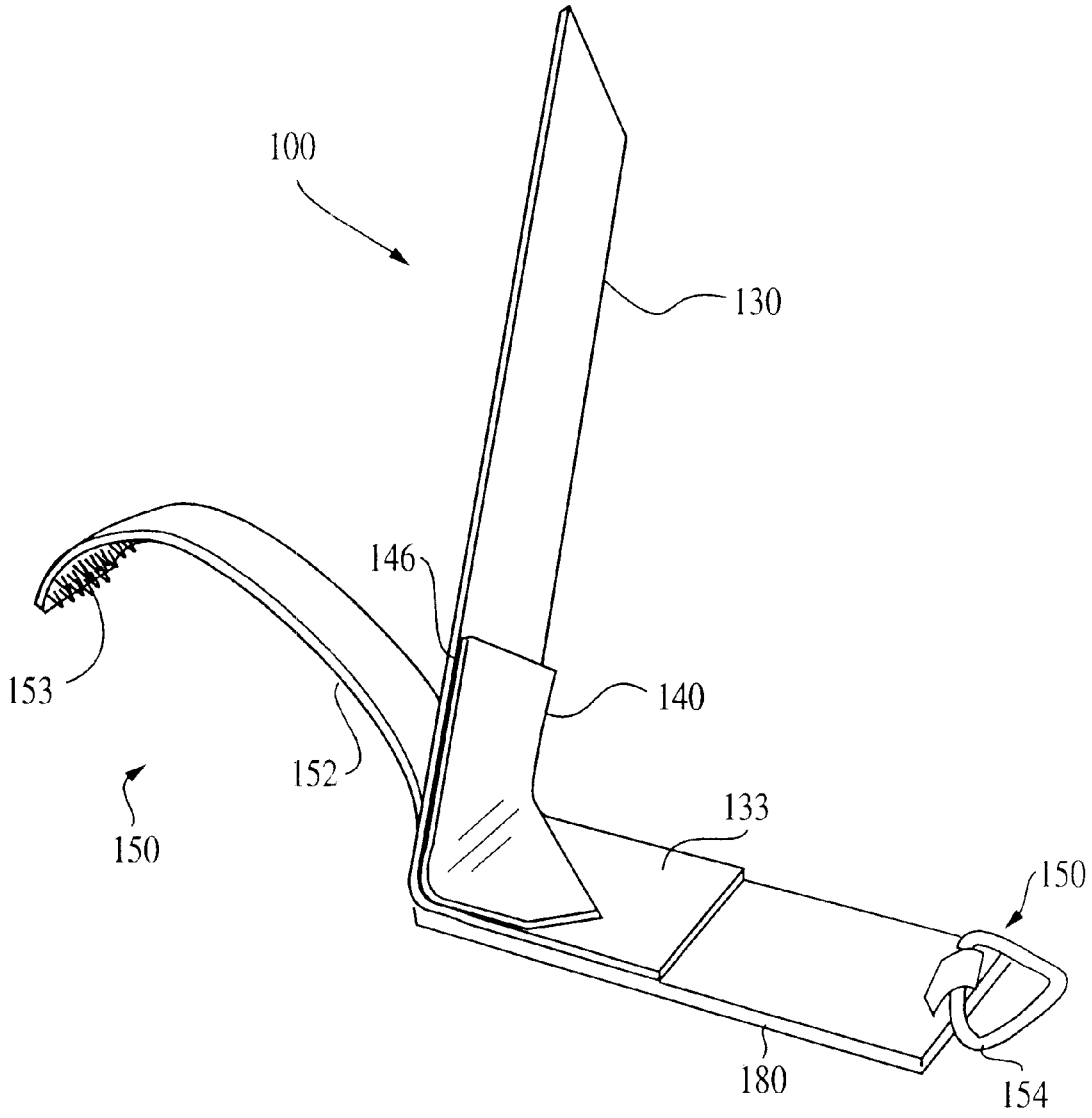
FIG. 5 is a perspective view of an alternate embodiment of the foot retention device in an open configuration.
Figure 6:
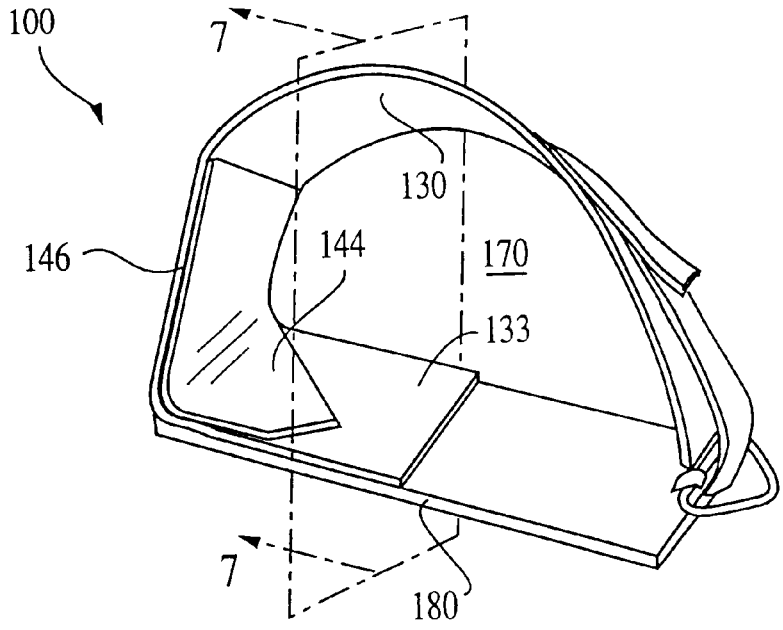
FIG. 6 is a rear view of the foot retention device in FIG. 5 in a closed operative configuration.
Figure 7:
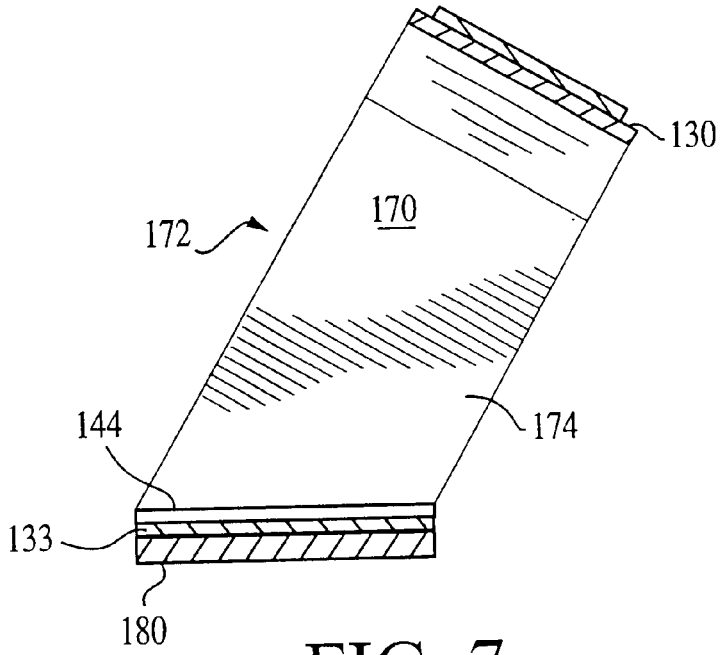
FIG. 7 is a longitudinal cross-sectional view of the foot retention device.

FIGS. 5 and 6 are perspective views of an alternative, casual embodiment 100 of the foot retention device wherein the band 130 and vertical strut 140 are sloped forward. As a result, in FIG. 7, the opening 170 comprises an inlet, or entry, 172 and an outlet, or exit, 174 wherein the inlet 172 is larger. The forward sloping band 130 is held in a closed, operative position by the securing mechanism 150 which comprises a Velcro strap 152 in the preferred embodiment. Similar to the first sport embodiment 20 shown in FIGS. 1–4, the band 130 of the casual foot retention device 100 is disposed on an outer side 146 of the vertical strut 140. The band 130 extends upwardly along the vertical strut 140 and then bends over the strut 140 to form an asymmetric arc. The device 100 further includes a horizontal base plate 180 coupled to the flexible band 130 and a horizontal strut portion 144 so as to provide a closed loop design to wrap around the user's foot. In the preferred embodiment, the band 130 includes a horizontal near portion 133 that is disposed between the base plate 180 and the horizontal strut portion 144. It is to be understood that the band 130 and the vertical strut 140 may be coupled to the base plate in a variety of ways. For example, the vertical strut 140 and the base plate 180 may be formed as a single integral structure with the band 130 being coupled to the outer side 146 of the strut 140 or the bottom surface of the base plate 180.

The releasable securing mechanism 150 includes a D-ring 154 coupled to the base plate 180 opposite from the vertical strut 140. The strap 150 may include Velcro portions 153 such that the strap 150 may be inserted through the D-ring 154 and secured onto itself by virtue of the Velcro portions 153.

Whereas conventional straps used in sandals droop due to a lack of rigidity, the foot retention device 100 according to the invention provides a rigid asymmetric arc having a downwardly forward slope that anatomically conforms to the forward slope of the human foot. It is to be understood that the casual foot retention device 100 may also be applied to sporting boards.

Figure 8:
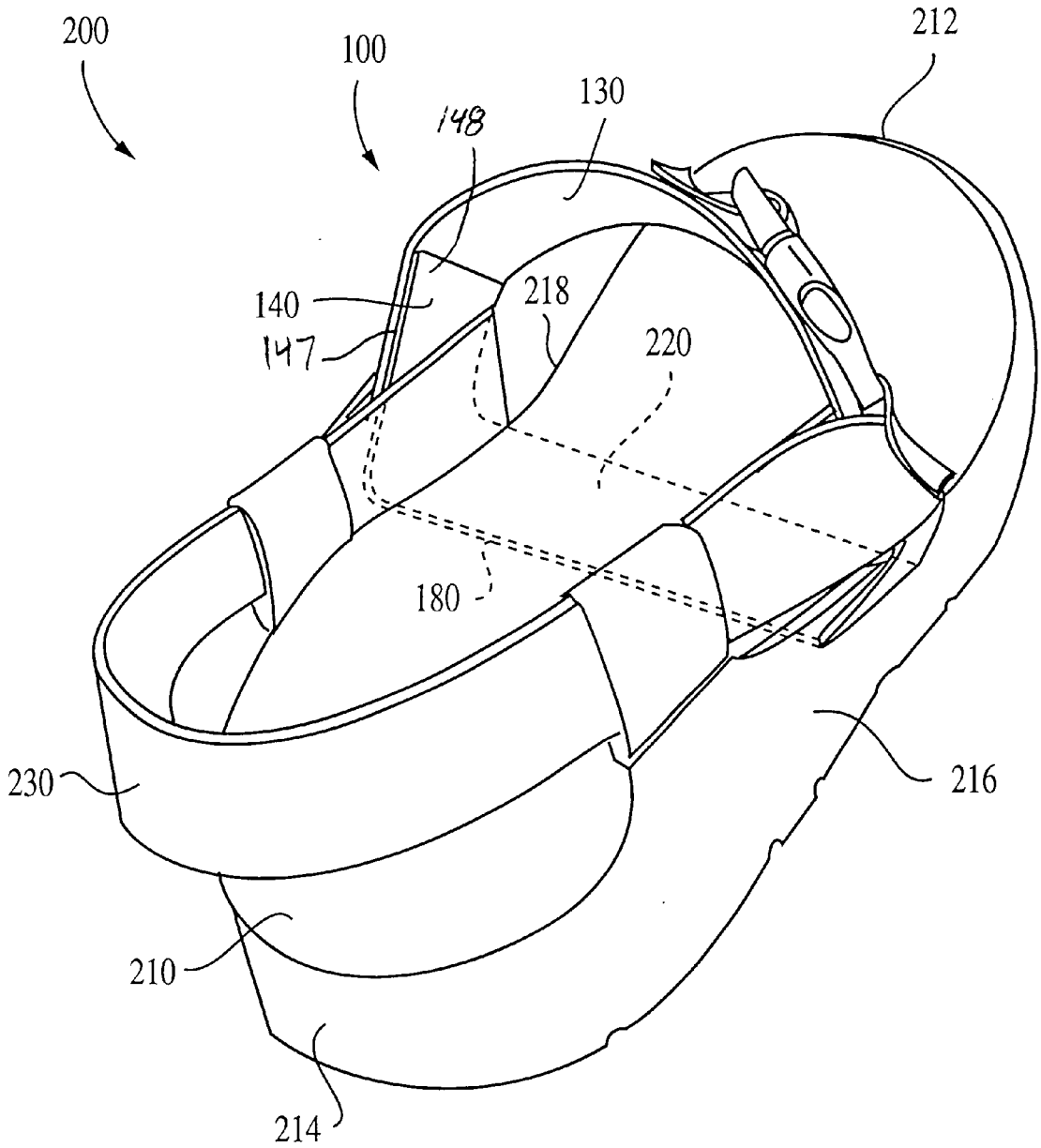
FIG. 8 is a perspective view of a shoe incorporating the alternate embodiment of the foot retention device.

FIG. 8 is a perspective view of a shoe 200 incorporating the casual foot retention device 100 according to the invention. The shoe 200 includes a sole 210 having a transverse horizontal slot 220 defined therethrough. The sole 210 has a front end 212, a rear end 214, a lateral side 216 and a medial side 218. The slot 220 is preferably disposed adjacent to the location of the arc of bottom surface of the user's foot when in use and is open to both the lateral side 216 and the medial side 218. Since the vertical strut 140 is adapted to be adjacent to the medial side of the user's foot, the strut 140 is disposed adjacent to the medial side 218 of the sole 210 and the exterior side 147 of the strut 140. The vertical strut 140 also has an interior side 148 opposite the exterior side 147. Thus, a right shoe 200 is shown in FIG. 8.

The base plate 180 is inserted through the slot 220. To close the foot retention device 200, the band 130 is bent over the vertical strut 140 and downwardly toward the lateral side 216 of the sole 210. An optional heel strap 230 may be included to provide a more secure fit of the user's foot.

It will be appreciated that the casual foot retention device 100 as applied to footwear provides a foot conforming fit by creating a non-drooping asymmetric arc that conforms to the asymmetric profile of the user's foot. This is made possible by the combination of a rigid vertical wall and a springy band flexed over the vertical wall.

Many alterations and modifications may be made by those having ordinary skill in the art without departing from the spirit and scope of the invention. For example, though only a single band is disclosed in each of the preferred embodiments, it is to be expressly understood that multiple bands may be employed for a single foot retention device. Therefore, it must be understood that the illustrated embodiment has been set forth only for the purposes of example and that it should not be taken as limiting the invention as defined by the following claims. The claims are thus to be understood to include what is specifically illustrated and described above, what is conceptionally equivalent, what can be obviously substituted and also what essentially incorporates the essential idea of the invention.

What is claimed is:

1. A foot retention device for releasably securing a user's foot adjacent to a base, the base having a big toe insertion region and small toe insertion region, the device comprising:

a substantially rigid vertical strut that extends perpendicularly from the base adjacent the big toe insertion region;

a resilient band extending from an upper end of the vertical strut; and a fastener for releasably coupling a far end of the resilient band to the small toe insertion region;

wherein the vertical strut and the resilient band combine to form an asymmetric arc profile conforming to a profile of the user's foot.

2. The device of claim 1 wherein the resilient band comprises metal.

3. The device of claim 1 wherein the resilient band has a uniform thickness.

4. The device of claim 1 wherein the resilient band comprises a spring-back cantilever.

5. The device of claim 1 further comprising a horizontal member extending from the vertical strut, the horizontal member being coupled to the base.

6. The device of claim 5 wherein the resilient band includes a near end that is coupled to the horizontal member.

7. The device of claim 1 wherein the fastener comprises a strap coupled to the band.

8. The device of claim 1 further comprising a securing mechanism disposed at the small toe region of the base for releasably engaging with the fastener.

9. The device of claim 1 wherein the vertical strut and the resilient band is sloped to provide an inlet opening that is larger than an outlet opening.

10. A stand-up riding apparatus comprising:

a board having a substantially flat upper surface for supporting a user's feet;

a rigid vertical wall coupled to the board and extending from the upper surface of the board to form a fixed angle for receiving a big toe of the user's foot; and a springy band having a near end disposed adjacent to a first side of the wall, wherein the band is bent over and shouldered by the wall to extend to a far end disposed beneath a top of the wall when the far end is coupled to the board.

11. The apparatus of claim 10 wherein the rigid vertical wall and the springy band collectively form an asymmetric profile conforming to a profile of the user's foot.

12. The apparatus of claim 10 further comprising a fastener releasably coupling the far end of the band to the board.

13. The apparatus of claim 10 wherein the band has a uniform thickness.

14. The apparatus of claim 10 wherein the band comprises metal.

15. A method of assembling a stand-up riding apparatus, the method comprising:

providing a board with an upper surface for supporting a rider's feet;

coupling a rigid vertical strut to the board;

disposing a flexible metallic band adjacent to an inboard side of the rigid vertical strut;

bending the flexible metallic band over a top of the rigid vertical strut, and releasably coupling the flexible metallic band to the board.

16. The method of claim 15 wherein releasably coupling the flexible metallic band to the board comprises forming an asymmetric arc with the flexible metallic band.

17. The method of claim 15 wherein releasably coupling the flexible metallic band to the board comprises coupling to the flexible metallic band a strap with a releasable mechanism.

18. The method of claim 15 wherein coupling a rigid vertical strut to the board comprises forming a right angle between the strut and the upper surface of the board for insertion of a big toe of the user.

* * * * *

UNITED STATES PATENT AND TRADEMARK OFFICE

CERTIFICATE OF CORRECTION

PATENT NO. : 6,368,173 B1
DATED : April 9, 2002
INVENTOR(S) : Runyan

It is certified that error appears in the above-identified patent and that said Letters Patent is hereby corrected as shown below:

Column 8,
Line 31, change "inboard" to -- outboard --.

Signed and Sealed this

Twenty-third Day of July, 2002

*Attest:*

*Attesting Officer*

JAMES E. ROGAN
*Director of the United States Patent and Trademark Office*